US005109790A

United States Patent [19]

Matsumoto et al.

[11] Patent Number: 5,109,790

[45] Date of Patent: May 5, 1992

[54] FLOOR COATING AGENT APPLYING MACHINE

[75] Inventors: Yasuhiko Matsumoto; Katsuaki Nanba; Isao Morita, all of Osaka, Japan

[73] Assignee: Penguin Wax Co., Ltd., Osaka, Japan

[21] Appl. No.: 548,298

[22] Filed: Jul. 5, 1990

[30] Foreign Application Priority Data

Apr. 4, 1990 [JP] Japan ..... 2-90777

[51] Int. Cl.[5] ..... B05C 11/06

[52] U.S. Cl. ..... 118/63; 118/108; 118/109; 118/207; 118/305

[58] Field of Search ..... 118/62, 63, 108, 109, 118/120, 207, 256, 266, 305, 323; 15/98, 50.1, 50.2, 320

[56] References Cited

U.S. PATENT DOCUMENTS

| | | | |
|---|---|---|---|
| 2,476,926 | 7/1949 | Stocks | 118/207 |
| 3,655,444 | 4/1972 | Young | 134/6 |
| 3,785,001 | 1/1974 | Niemi et al. | 118/108 X |
| 4,471,713 | 9/1984 | Cote et al. | 118/207 X |
| 4,732,109 | 3/1988 | Selby | 118/108 X |
| 4,910,824 | 3/1990 | Nagayama et al. | 118/108 X |

FOREIGN PATENT DOCUMENTS

| | | |
|---|---|---|
| 166050 | 1/1986 | European Pat. Off. . |
| 8624659 | 7/1988 | Fed. Rep. of Germany . |
| 63-315169 | 12/1988 | Japan . |

*Primary Examiner*—Richard L. Chiesa

*Attorney, Agent, or Firm*—Gifford, Groh, Sprinkle, Patmore and Anderson

[57] ABSTRACT

A floor coating agent applying machine having propelling wheels attached to a machine body and an applying device for applying floor coating agent onto a floor surface by an applying member. The applying device is vertically movably mounted on the machine body between a free-lift state where the device is lowered, by a dead weight thereof, relative to the machine body to place the applying member into pressure contact with the floor surface and a lift-up state where the applying member is lifted up away from the floor surface. A control member is provided for selectably bringing the applying device into the free-lift state or the lift-up state.

9 Claims, 3 Drawing Sheets

FLOOR COATING AGENT APPLYING MACHINE

BACKGROUND OF THE INVENTION

1. Field of the Invention

The present invention relates to a floor coating agent applying machine having propelling wheels and an applying device for applying floor coating agent onto a floor surface by means of an applying member.

2. Description of the Related Art

A floor coating agent applying machine of the above-noted type is known from e.g. a Japanese laid-open patent gazette No. 63-315169. In this machine, the applying device is fixedly attached to a machine body.

With the above-described conventional machine, however, setting and adjustment of applying pressure of the applying member must be effected by appropriately setting relative height between the applying member of the applying device and the propelling wheels. This tends to be difficult because of manufacturing and assembly errors and/or tolerances often present in the various elements constituting the applying device and the wheels. As a result, the actual applying pressure of the applying member often deviates from a desired value. Further, when the machine, i.e. its propelling wheels and applying member travel on an uneven floor surface, there inevitably occurs change in the height of the machine with respect to the floor face, which change results in change in the applying pressure. These effects, as combined, will render the finish condition poor.

Accordingly, the primary object of the present invention is to provide an improved floor coating agent applying machine which is capable of maintaining the applying pressure at a proper value throughout an applying operation irrespectively of unevenness in a floor surface and which is superior in controllability as well.

SUMMARY OF THE INVENTION

For accomplishing the above-described object, a floor coating agent applying machine, according to the present invention, comprises: machine propelling wheels attached to a propelling machine body; an applying device for applying floor coating agent onto a floor surface by means of an applying member; wherein the applying device is vertically movably mounted on the machine body between a free-lift state where the device is lowered, by a dead weight, relative to the machine body to place the applying member into pressure contact with the floor surface and a lift-up state where the applying member is lifted up away from the floor surface and a control member is provided for selectably bringing the applying device into the free-lift state or the lift-up state.

Functions and effects of the above construction will be described next.

If the control member is operated to bring the applying device into the lift-up state, the applying member is lifted up away from the floor surface, whereby the machine can travel and maneuver smoothly without unnecessary friction or contact between the applying member and the floor surface. On the other hand, if the control member is operated to bring the applying device into the free-lift state, the applying member is brought into pressure contact with the floor surface by the dead weight of the applying device, thereby enabling an applying operation.

The contact pressure, as the applying pressure, between the applying member and the floor surface is determined by the dead weight of the applying device. Thus, even if there exist some manufacturing and assembly errors or tolerances in the propelling wheels and/or the applying device, the applying pressure can be maintained properly by appropriately determining the dead weight of the applying device. Further, when the propelling wheels and the applying member travel on an uneven floor surface, i.e. a ridge or a recess in the surface, the applying device will freely move up or down relative to the machine body by an amount depending on the magnitude of and shape of the unevenness, whereby the applying pressure can still be maintained properly.

Advantageously, the applying device is made capable of dead-weight rolling action. This feature is advantageous in that the applying device can swing to automatically follow the unevenness in the floor surface with respect to the propelling machine body whereby the applying pressure can be maintained properly through the entire working face of the applying machine.

In summary, according to the present invention, the applying pressure of the applying device is obtained by the dead weight of the applying device per se. Therefore, through appropriate setting of the dead weight which setting is much easier than control of manufacturing and assembly errors and tolerances, the applying pressure can be constantly maintained at a proper value irrespective of possible unevenness in the floor surface to be treated. Consequently, the machine can assure superior finish all the time.

Moreover, because of the control member used for selectably providing the free-lift state and the lift-up state of the applying machine which latter state is convenient and useful for e.g. a turning operation of the propelling machine, the controllability and maneuverability of the machine has been improved as well.

Incidentally, although it is conceivable to adapt the applying device only to move upwards in the free-lift state, the above-described feature of the rolling function will be more advantageous in actuality.

Further and other objects, features and effects of the invention will become more apparent from the following more detailed description of the embodiments of the invention with reference to the accompanying drawings.

DESCRIPTION OF THE PREFERRED EMBODIMENTS

Preferred embodiments of a floor coating agent applying machine relating to the present invention will be particularly described hereinafter with reference to the accompanying drawings.

Figure 1:
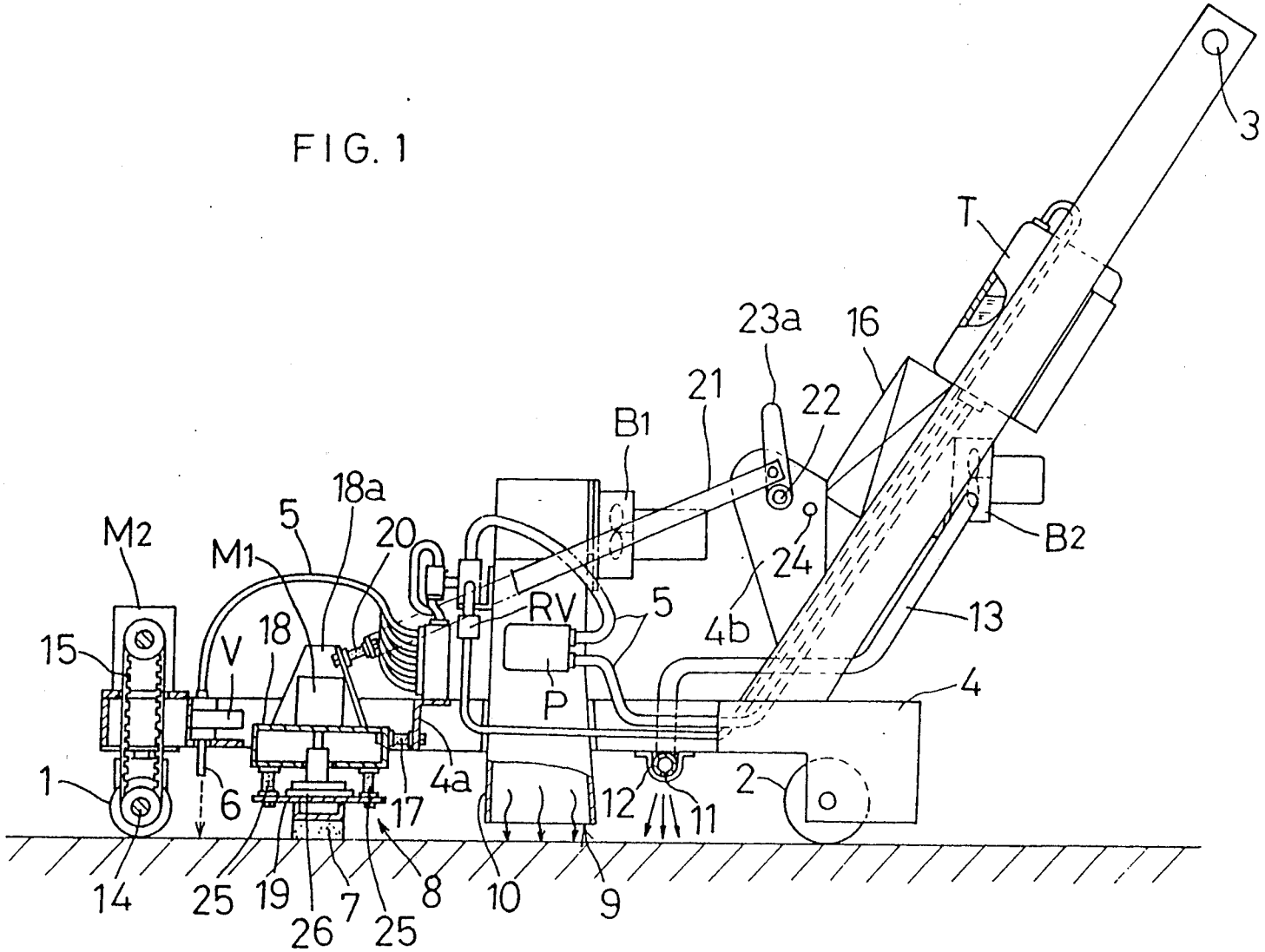
FIG. 1 is a partially cutaway side view showing a floor coating agent applying machine relating to the present invention.
Figure 2:
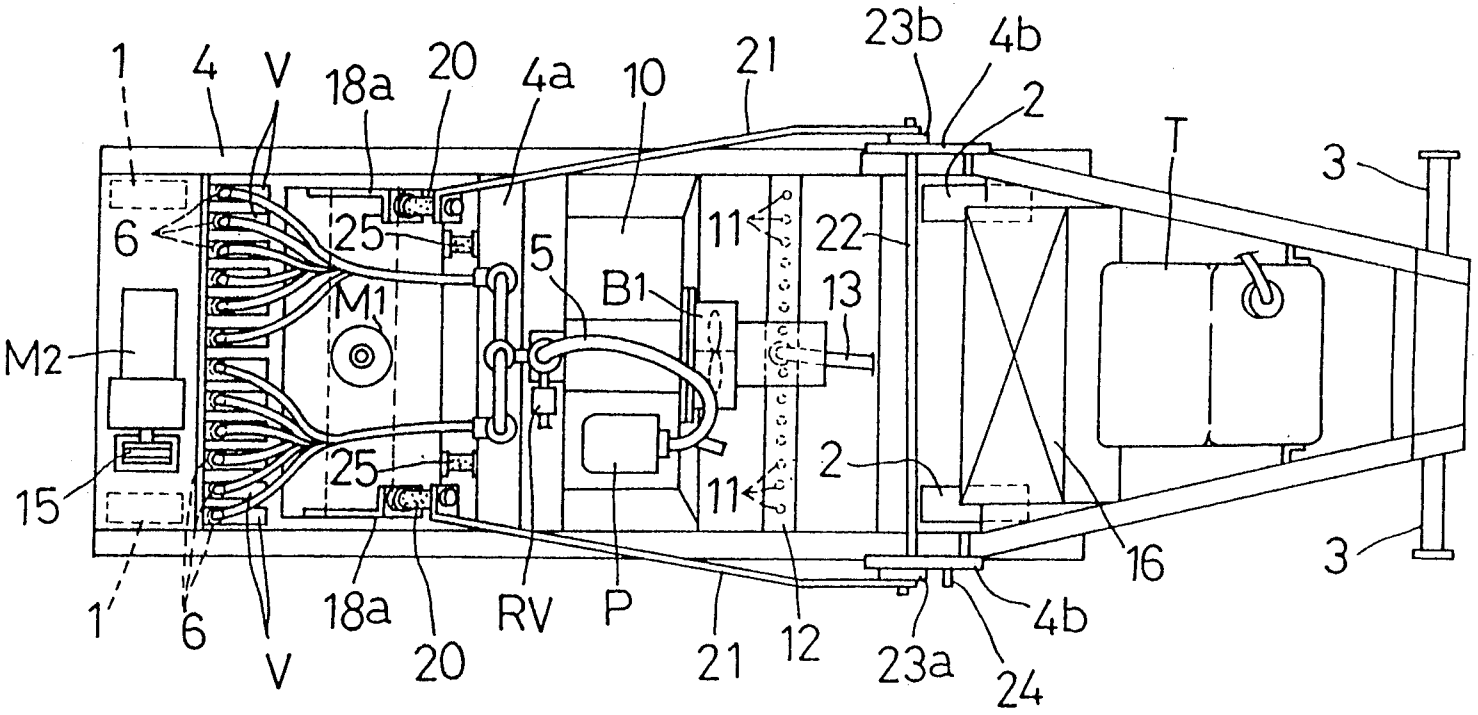
FIG. 2 is an overall plane view of the applying machine of the invention.

As shown in FIGS. 1 and 2, a floor coating agent applying machine includes a propelling type machine body 4, a pair of right and left propelling, i.e. driving front wheels 1, 1, a pair of right and left non-driving, i.e. free rotation rear wheels 2, 2, a steering handle 3 and a coating agent tank T disposed at a rear position of the machine body 4.

At a forward end of the machine body 4, there are attached a plurality of feed nozzles 6 . . . , disposed side by side in the transverse dirction of the machine body 4. These feed nozzles 6 . . . are connected with the tank T through an electric pump P and a feed tube 5 incorporating therein a relief valve RV, so that floor coating agent or liquid is fed supplied from the tank T to the respective feed nozzles 6. Further, the machine body 4 also mounts an applying device 8 including an applying member 7 positioned rearwardly of the nozzles 6 and an electric motor M1 and so on. The machine body 4 further mounts an air guide member 10 defining a hot air discharge opening 9 oriented downwards rearwardly of the applying member 7. This air guide member 10 is adapted for introducing therein air from an electric blower B1 disposed above the member 10 and for discharging this air after heating thereof by an unillustrated electric heater through the hot air discharge opening 9 onto the floor surface. At a bottom of the machine body 4, there is attached a pipe 12 which forms a plurality of downwardly-oriented blower openings 11 . . . disposed side by side rearwardly of the hot air discharge opening 9 along the transverse direction of the machine body 4. Also, a further electric blower B2 is attached to a rear region of the machine body 4, so that the blower B2 feeds air flow of room temperature through an air feed tube 13 to the pipe 12. As a result, the room-temperature air is distributed and discharged through all the discharge openings 11 . . . downwardly to the floor surface. A machine-propelling electric motor M2 is attached to a front end region of the machine body 4 for driving the right and left front wheels 1, 1 through a front axle 14 and a transmission belt 15. A control unit 16 is attached to a rear position of the machine body 4 for controlling the electric pump P, an electromagnetic valve V, the electric blowers B1 and B2 and the electric motors M1 and M2. These devices and members together constitute the self-propelled type floor coating agent applying machine.

In operation, a thermoplastic resin type floor coating solution is discharged and reserved in the tank T, and the machine is self-propelled on a target floor formed of stone, wood, concrete, various kinds of artificial materials or the like. Then, in automatic response to this propelling action of the machine body, the pump P withdraws the floor coating solution from the tank T and feeds the solution evenly to all the feed nozzles 6 . . . while returning excess solution via the relief valve RV to the tank T. More specifically, each of the feed nozzles 6 . . . feeds and discharges a predetermined amount of the solution onto the floor surface and then the applying member 7 applies the discharged solution over the floor surface. Next, the hot air through the hot air discharge openings 9 heats the solution applied by the applying member and evaporates water content therein for plasticizing the same. Then, the room-temperature air flow through the air discharge opening 11 cools and cures the solution.

The construction of the applying device 8 will be more particularly described next.

As shown in FIG. 1, the applying member 7 is attached through an attaching plate 19 to a lower face of an applying-device frame 18 made of plate metal. This attaching plate 19 has its rear end attached to a frame portion 4*a* of the machine body 4 through a pair of right and left connecting rubber elements 17, 17. Further, on the upper face of the frame 18, there is mounted the electric motor M1. Further, a lever type control member 23*a* or 23*b* is attached to a control member support portion 4*b* of the machine body 4 through a pivot shaft 22 acting also as a control member link shaft. Then, with a manual pivotal operation on this control member 23*a* (23*b*), there is selectively provided an operative, free-lift state of the applying device 8 or an inoperative, lift-up state of the same for storage.

More particularly, when either of the right and left control members 23*a* or 23*b* is forwardly pivoted on the pivot axis in the longitudinal direction of the machine body 4, the applying device 8, by its dead weight, elastically deforms the connecting rubber elements 17 and moves downwards relative to the machine body 4. With this, the applying member 7 is brought into pressure contact with the floor surface at a predetermined pressure of about 50 g/cm$^2$ determined by the effective applying area of the applying member 7 and also by the dead weight of the applying device 8. If the propelling wheels 1, 2 and the applying member 7 travel on some unevenness present in the floor surface, due to elastic deformation of the connecting rubber elements 17, some looseness in connection resultant from free pivotal motions of the control members 23*a* and 23*b* with respect to the attaching portion 4*b*, reaction received by the applying member 7 from its contact with the floor face and also to the dead weight of the applying device, the applying device 8 effects a free lift or rolling motion relative to the machine body 4. As a result, the machine can applying the coating agent uniformly to the floor surface despite the floor surface unevenness, i.e. undulations and/or slants. This is the free-lift state of the applying device 8.

Figure 3:
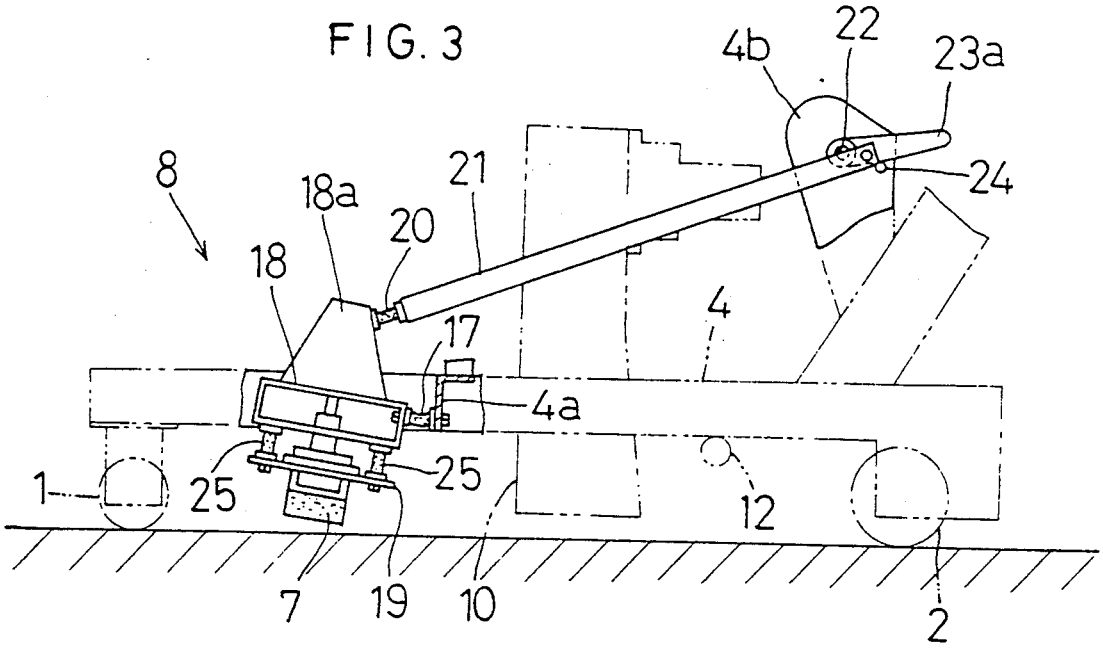
FIG. 3 is a side view of an applying device mounted on the machine.

On the other hand, as shown in FIG. 3, if the control member 23*a* or 23*b* is operated in the opposite direction until both these control members 23*a* and 23*b* move to positions rearwardly of the machine body where a free of the operated control member 23*a* (23*b*) comes into contact with a stopper pin 24 attached to the control member support portion 4*b*, this operating force is transmitted through a link rod 21 and so on to lift up the applying device 8 while deforming the connecting rubber elements 17. This is the lift-up state of the applying device where the applying device 8 is lifted away from the floor surface for facilitating the propulsion of the machine body 4 and is maintained at this state with the device 8 being supported by the stopper pin 24.

Figure 4:
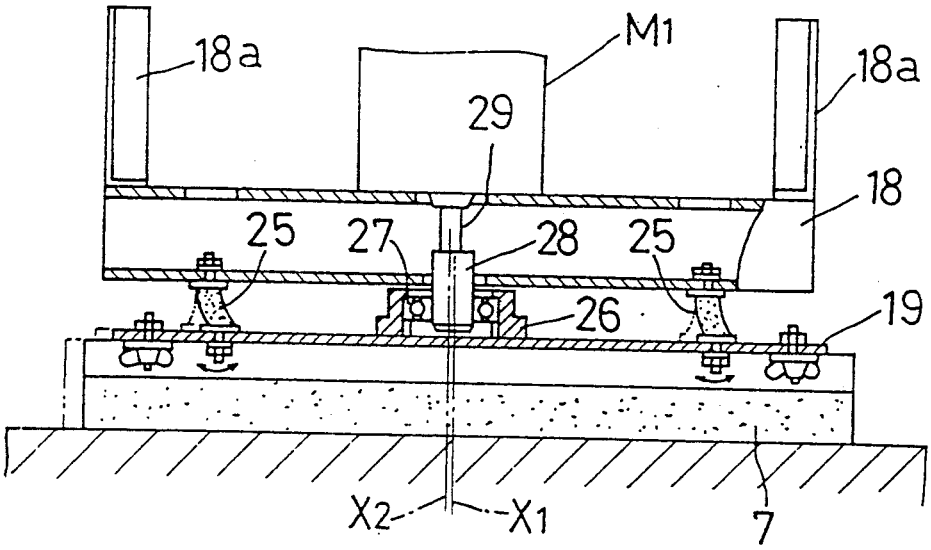
FIG. 4 is a partially cutaway front view of the applying device of FIG. 3.

As shown in FIG. 4, for enabling the electric motor M1 to drive the applying member 7, the applying-device attaching plate 19 is attached to the frame 18 through a plurality of connecting rubber elements 25 . . . disposed vertically relative to the machine body. Further, on the upper face of the attaching plate 19, there is mounted a bearing holder 18 supporting therein ball bearings 27 and a rotary cam 28 surrounded by the bearings 27. The rotary cam 28 is fitted on a motor output shaft 29 so as to be rotatably driven by the motor M1 about a vertical axis X2 which is displaced relative to an inner ring rotary axis X1 of the ball bearings 27. In operation, as the electric motor M1 is driven, because of the resultant rotational force of the rotary cam 28 and of the eccentric arrangement of the axes X1 and X2, the applying-member attaching plate 19 rotates about the vertical axis X2 so that the applying member 7 rotates about this vertical axis X2 along the floor surface. Further, with the rotary motion of the applying-member attaching plate 19, this motion causes all the connecting rubber elements 25 . . . to pivot at or relative to their top ends fixed to the frame 18 while their lower ends fixed to the attaching plate 19 effect vertical motion. Consequently, the applying member 7 effects a vertical swing motion.

Some alternate arrangements will be specifically described next.

The front wheels can comprise free rotation type instead of the motor-driven type disclosed in the foregoing embodiment, so that the machine body 4 can be propelled manually.

It is conceivable to arrange so that the applying member 7 effects only either the rotary motion or the vertical swing motion. Further, the applying member 7 can be adapted to effect neither the rotary motion nor the vertical swing motion so that the member 7 applies the agent while sliding on the floor surface with the propelling action of the machine body.

For the free-lift and dead-weight rolling arrangement of the applying device 8, any other convenient means should be apparent for one skilled in the art rather than the connecting rubber elements 17 and 20. For instance, for the attachment to the machine body 4 and for the operative connection with the control members 23*a* and 23*b*, various attaching or connecting means such as pivot shafts, connecting pins with corresponding slots, hinges, chains or cables can be employed depending on the convenience and necessity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A floor coating agent applying machine comprising:

machine propelling wheels attached to a propelling machine body;

an applying member for applying a floor coating agent;

an applying device for applying said floor coating agent onto a floor surface by means of said applying member;

an air blower; and at least one air guide member having one end connected to said air blower and a discharge opening defined in a position rearwardly of the machine body compared with the applying member and attached to said machine body to supply the air from said air blower for drying said coating agent applied onto said floor surface, wherein said applying device is vertically movably mounted on the machine body between a free-lift state where the device is lowered, by a dead weight thereof, relative to the machine body to place the applying member into pressure contact with the floor surface and a lift-up state where the applying member is lifted up away from the floor surface and a control member is provided for selectively bringing the applying device into the free-lift state or the lift-up state.

2. A floor coating agent applying machine as defined in claim 1, wherein said applying device is so mounted on said propelling machine body as to effect dead-weight rolling action in said free-lift state.

3. A floor coating agent applying machine as defined in claim 1 or 2, said applying device includes said applying member attached through an attaching plate to a lower face of an applying-device frame made of plate metal with said attaching plate having a rear end thereof attached to a frame portion of said machine body through a pair of right and left connecting rubber elements and an electric motor mounted on an upper face of said applying-device frame.

4. A floor coating agent applying machine as defined in claim 3, wherein said attaching plate mounts on its upper face a bearing holder supporting therein bearings and a rotary cam surrounded by said bearings, said rotary cam being fitted on an output shaft of said electric motor so as to be rotatably driven about a vertical axis which is displaced relative to an inner ring rotary axis of said bearings.

5. A floor coating agent applying machine comprising:

a propelled machine body having machine propelling wheels attached to said propelled machine body;

said propelled machine body having a forward end and a rear end;

an applying device for applying a floor coating agent onto a floor surface mounted to said propelled machine body towards said forward end and having an applying member;

an air blower;

at least one air guide member having one end connected to said air blower and a discharge opening positioned on said propelled machine body between said applying member and said rear end and being attached to said propelled machine body to supply air onto said floor surface for drying said coating agent applied onto said floor surface;

a control member connected to said applying device; and wherein said applying device is vertically movably mounted on said machine body between a free-lift state where said applying device is lowered, by a dead weight thereof, relative to said propelled machine body to place said applying member into pressure contact with said floor surface and a lift-up state where said applying member is lifted up away from said floor surface and said control member selectively controls movement of said applying device into said free-lift state or said lift-up state.

6. A floor coating agent applying machine as defined in claim 5, said applying device further comprising:

a frame having an upper and a lower face, and having an attaching plate having a front end and a rear end;

said applying member attached through said attaching plate to said lower face of said applying-device frame;

said machine body having a frame;

said attaching plate having said rear end thereof attached to said frame portion of said machine body through at least a pair of connecting rubber elements and an electric motor mounted on said upper face of said applying-device frame.

7. A floor coating agent applying machine as defined in claim 5, wherein said applying device is so mounted on said propelled machine body as to effect dead-weight rolling action in said free-lift state.

8. A floor coating agent applying machine as defined in claim 7, further comprising:

said propelled machine body having a frame portion;

said applying device including a frame and an attaching plate connected to said applying member;

said attaching plate being connected to said applying-device frame and made of plate metal and having an upper and lower face;

said attaching plate having a rear end, said rear end of said attaching plate attached to said frame portion of said propelled machine body through connecting rubber elements and an electric motor mounted on an upper face of said applying-device frame.

9. A floor coating agent applying machine as defined in claim 8, wherein said attaching plate has a bearing holder mounted on its upper face, bearings supported in said bearing holder, said bearings having an inner ring forming a rotary axis, a rotary cam surrounded by said bearings, said electric motor has an output shaft, and said rotary cam being fitted on said output shaft of said electric motor so as to be rotatably driven about a vertical axis which is displaced relative to said inner ring rotary axis of said bearings.

* * * * *